United States Patent [19]

Brombach et al.

[11] Patent Number: 4,810,130

[45] Date of Patent: Mar. 7, 1989

[54] SIPHON WEIR WITH A VENTILATING MECHANISM

[75] Inventors: Hansjörg Brombach, Von-Berlichingen-Strasse 21, D-6990 Bad Mergentheim-Neunkirchen, Fed. Rep. of Germany; Eric Markland, Cardiff, Great Britain

[73] Assignees: Dr. Hansjorg Brombach; Heinrich Hohlwegler, both of Fed. Rep. of Germany

[21] Appl. No.: 62,512

[22] Filed: Jun. 15, 1987

[30] Foreign Application Priority Data

Jun. 13, 1986 [DE] Fed. Rep. of Germany ..... 3619995

[51] Int. Cl.[4] ..... E02B 7/18

[52] U.S. Cl. ..... 405/80; 137/236.1; 137/143

[58] Field of Search ..... 405/52, 80, 87, 118; 137/123, 142, 143, 236.1

[56] References Cited

FOREIGN PATENT DOCUMENTS

| | | | |
|---|---|---|---|
| 243681 | 2/1912 | Fed. Rep. of Germany . | |
| 241300 | 10/1918 | Fed. Rep. of Germany . | |
| 1634201 | 8/1970 | Fed. Rep. of Germany . | |
| 378787 | 8/1982 | Fed. Rep. of Germany . | |
| 3245316 | 11/1983 | Fed. Rep. of Germany . | |
| 676676 | 7/1979 | U.S.S.R. ..... | 405/80 |
| 696095 | 11/1979 | U.S.S.R. ..... | 405/80 |

*Primary Examiner*—David H. Corbin

*Attorney, Agent, or Firm*—Steele, Gould & Fried

[57] ABSTRACT

A siphon weir having a downwardly directed inlet port and a lower lying outlet port (18) on the downstream side connected with it by means of an approximately S-shaped siphon line (13) contains a ventilating mechanism for improving the regulating behavior. The ventilating mechanism is preferably constructed as a linear, sloping ventilating pipe (46), which is led out of the interior of the container to be regulated through the rising leg of the siphon line (13) and issues below the siphon top in the downwardly leading falling leg of siphon line (13). A diverter (28) for floating material can be mounted on the upper end of ventilating pipe (46).

17 Claims, 2 Drawing Sheets

SIPHON WEIR WITH A VENTILATING MECHANISM

The present invention relates to a siphon weir with a downwardly directed upstream intake port, which is connected with the aid of a siphon line leading via a siphon top positioned higher than the intake port to a downstream, lower lying outlet port, as well as with a ventilating mechanism for ventilating the flow flowing through the siphon line as a function of the upper water level.

It has long been known to use siphons for regulating the water level of containers. Siphons have a much greater efficiency than overflow thresholds. In siphons, the siphon intake is well below the siphon top, which corresponds to the desired water level. This is done to ensure that only water is sucked in, because the simultaneous sucking in of air and water leads to unstable conditions. Due to the lower location of the intake a considerable hysteresis occurs, which leads to a reservoir volume loss.

It is known to use ventilating mechanisms in siphons to eliminate the hysteresis. In a known siphon (German Pat. No. 378 787) a ventilating pipe leads from the upstream side into the siphon line, into which it issues at the highest point. The other end of the pipe terminates in the container to be regulated level with the siphon top corresponding to the desired water level. Through the provision of ventilating means hysteresis is reduced, but does not reach an optimum characteristic.

A siphon weir is also known (DE-OS No. 32 45 316), in which a ventilating means is provided in the apex of the siphon weir. The quantity of air sucked in there can be regulated as a function of the upper water level. However, in the case of this ventilating mechanism it is necessary to have a valve to be operated by using control elements. When using such a mechanism in conjunction with waste water, there is a risk of contamination.

An object of the invention is to provide a simply constructed, robust and uncomplicated siphon weir, which has a hysteresis-free, proportional and very flat characteristic.

According to the invention this object is achieved by a siphon weir, in which the ventilating mechanism has at least one ventilating pipe, whereof one end issues below the siphon top into the falling leg of the siphon line and whose other end is located roughly level with the siphon top on the upstream side. Thus, the upper end issues within the container, whose water level is to be regulated. The other, lower end issues in the downstream branch or falling leg of the siphon line, where it leads to a particularly appropriate ventilation of the flow. No valve or simialr moving part is positioned at the upper end of the ventilating pipe. As soon as the siphon starts to operate, air is initially sucked in and subsequently mixed air and water up to a given level, as from which only water is sucked in. As there are no moving parts, it is possible with the aid of this construction to obtain a proportional, flat and hysteresis-free characteristic.

According to a further development the ventilating pipe transversely passes through the upstream branch or rising leg of the siphon line. Thus, the pipe passes from the interior of the container in slightly sloping manner through the rising leg of the siphon line up to the inner wall of the falling leg, which is also called a suction tube. The ventilating pipe may project inwards somewhat with respect to the inner wall of the falling leg of the siphon line.

According to a further development of the invention, the ventilating pipe part arranged within the rising leg of the siphon line has a second ventilating opening. This leads to a further improvement to the characteristic of the siphon weir proposed by the invention. When the siphon weir starts up air is sucked in through the ventilating pipe mixed with water and is drawn through both ventilating openings into the interior of the siphon weir, so that a particularly good ventilation of the water flow occurs. According to the invention the lower edge of the suction port of the ventilating pipe is located roughly level with the siphon top. This means that water starts to flow through the ventilating pipe at the same time as water flows over the siphon top. For this purpose, on the outer end of the ventilating pipe it is possible to provide a ventilating nose, which has an inlet port, whose lower edge is at least partly located in a horizontal plane.

If the ventilating pipe slopes slightly downwards, before the water reaches the siphon top, through the second ventilating opening some water can flow into the interior of the ventilating pipe and from there through the siphon line. In order to eliminate this small water flow, the edge of the second ventilating opening can be positioned level with the siphon top. In the case of a pipe, this can be brought about by fitting to the opening a short, upwardly directed pipe connection, which is cut off in a horizontal plane aligned with the siphon top.

When using the siphon weir proposed by the invention for waste water, the suction port of the ventilating pipe can be equipped with a floating material diverter. For example this can be constituted by an opening or slot covered with a grating or crossbars. A further particularly advantageous possibility which is preferred by the invention is to construct the suction end as a T-shaped pipe length, in which the crossbeam is roughly vertically directed. The lower opening is then well below the desired water level, whilst the upper opening is well above it. In this case the water is not taken from the surface, so that floating material cannot enter the ventilating pipe.

For improving the flow conditions deflectors can be arranged in the vicinity of the apex of the siphon line on the outer and/or inner wall thereof and extend into the vicinity of the lower ventilating opening.

Considered in the flow direction, according to the invention the siphon line has a rectangular cross-section and/or the ventilating pipe is positioned centrally between the siphon side walls.

The ventilating pipe can be led in random form from the container into the siphon line. However, it is particularly favorable if the ventilating pipe is substantially linear. In this case it can be optionally cleaned very easily. However, it is e.g. also advantageously possible to construct it from two linear parts, which are fitted to one another at an angle. In this case part of the siphon weir wall can be traversed at right angles, so that the openings to be made in the siphon weir walls can be circular.

According to the invention the siphon weir can be constructed as a separate, box-like component and can in particular be constituted by high-grade steel plates and can then be subsequently installed on outflow barriers.

Advantageously the falling leg of the siphon line, which is also called a suction tube, can be constructed as a vertical tube with parallel walls. In this way it can be particularly easily fitted to the outer wall of an outflow barrier.

In order to improve the starting behaviour of the siphon weir, it can have an upwardly sloping outlet port. Thus, when flowing out, the water more rapidly closes the outlet port, so that as a result the waterjet pump action can start. In order to be able to empty the outlet end of the siphon at the end of siphon action, a small opening can be provided at the lowest point.

The siphon weir proposed by the invention has the further major advantage that it has no edges or projections in the vicinity of its top surface, i.e. in the apex region. Thus, in the case of a particularly strong water supply, water can also flow over it without any valve becoming obstructed.

Further features, details and advantages of the invention can be gathered from the following description of exemplified embodiments with reference to the attached drawings.

DETAILED DESCRIPTION OF THE PREFERRED EMBODIMENTS

Figure 1:
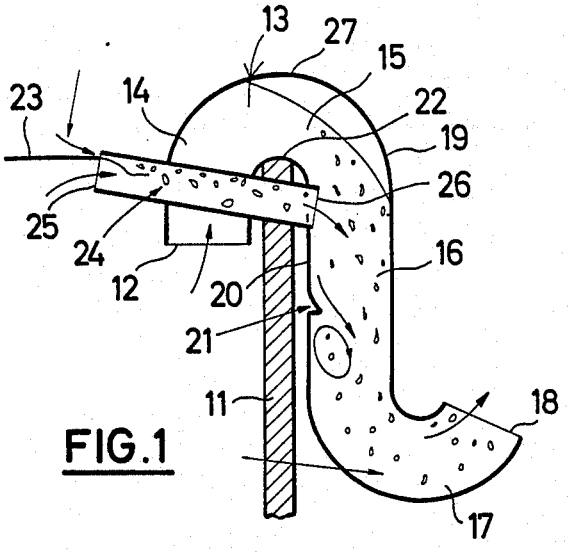
FIG. 1 is a diagrammatic cross-section through a siphon weir according to the invention.

The siphon weir shown in FIG. 1 is intended to regulate the water level within a container. The siphon weir is fixed to one wall 11 of the container. It contains an intake port 12, which is positioned within the container and which is downwardly directed. From intake port 12 extends an inverted U-shaped siphon line 13, the rising leg 14 leading roughly vertically upwards and over a curved portion or bend 15 in the falling leg 16. The latter, which is also called a suction tube, extends much lower than the intake port 12 and passes into an outflow bend 17, which contains the upwardly sloping outlet port 18. The siphon weir has throughout the same distance between outer wall 19 and inner wall 20. A nose-like projection 21 is positioned on the inside of the inner wall 20, roughly in the center of the falling leg 16 of siphon line 13 and said projection aids the starting of the siphon by passing the outflowing water to the facing outer wall 19.

The siphon top 22 forms the highest point of inner wall 20. This siphon top 22 represents the desired water level. As soon as the water level 23 in the container reaches the height of the siphon top 22, the siphon weir starts to operate.

According to the invention the siphon weir has a ventilating pipe 24, which slopes downwards from the interior of the container through the rising leg 14 of the siphon weir and into the falling leg 16. Ventilating pipe 24, which is open at both ends, consequently traverses the rising leg 14 of siphon line 13 and projects within the falling leg 16 over the inside of inner wall 20. As soon as the siphon weir starts to operate, i.e. as soon as there is a suction action in the siphon, the flow below the siphon top 22 is ventilated in the falling leg of the siphon line. In the case of a further rising water level, as shown in FIG. 1, water mixed with air is sucked in through ventilating pipe 24 up to a time when water level 23 is so high that no further air is sucked in. In this state, the complete siphon line 13 and ventilating pipe 24 are filled with water.

In the vicinity of its top surface, siphon line 13 has a completely smooth rounded configuration, which is not disturbed by any projections or edges. If, under extreme conditions, the water level 23 rises so high that it passes over the apex 27 of the siphon line, then the water can flow over the top of the siphon weir, but in no way impairs the latter.

Figure 2:
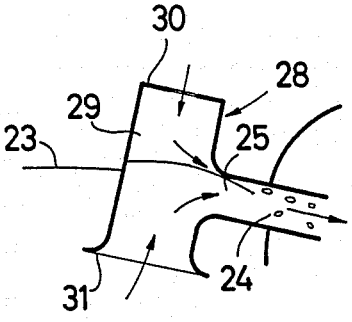
FIG. 2 is a cross-section through a floating material diverter.

In the embodiment according to FIG. 1, the upper end of ventilating line 24 is cut off in a plane at right angles to the longitudinal axis of ventilating pipe 24. This upper end 25 is roughly level with siphon top 22. As the ventilating pipe 24 draws off the water level with the water surface, floating material can consequently also pass through the ventilating pipe 24. To prevent this, the upper end 25 of ventilating pipe 24 can have a floating material diverter 28 according to FIG. 2. In the represented embodiment of the floating material diverter, the upper end 25 of ventilating pipe 24 has an approximately T-shaped construction, the crossbeam 29 of the T passing at right angles to ventilating pipe 24, i.e. roughly from top to bottom. The floating material diverter 28 is open on top surface 30 and bottom surface 31, so that the water can penetrate from the bottom surface 31. The water is taken from a layer which is clearly lower than water surface 23.

Figure 3:
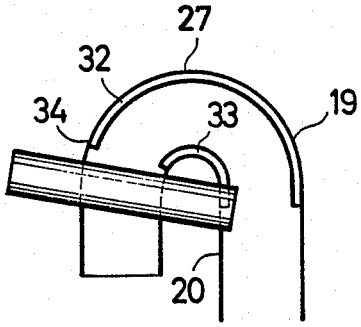
FIG. 3 is a cross-section corresponding to FIG. 1 in a different embodiment.
Figure 4:
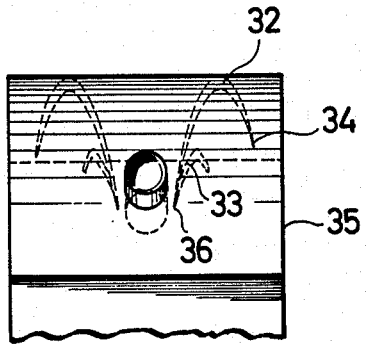
FIG. 4 is a view of the arrangement in FIG. 3 from the left.

FIGS. 3 and 4 diagrammatically show another embodiment in which deflectors 32, 33 are arranged on the inside of outer wall 19 and the inside of inner wall 20 in the vicinity of apex 27. Deflectors 32 lead from a start 34, which is in the vicinity of the side walls of siphon line 13, when considered in the flow direction, pass along the curvature of the apex to end 36, roughly in the vicinity of the lower end 26 of ventilating pipe 24. In the same way, deflectors 33 also pass from the outside to the inside on the inside of the curvature. Through the arrangement of deflectors approaching in the direction of the outlet end of ventilating pipe 24, there is a favorable influence on the flow, in order to achieve an advantageous turbulence.

Figure 5:
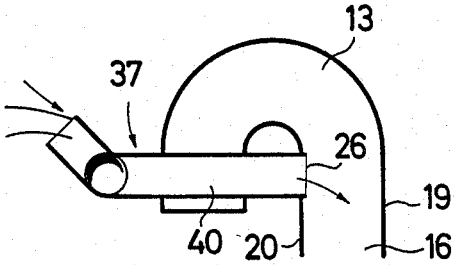
FIG. 5 is a simplified cross-section through an embodiment with a modified ventilating pipe.
Figure 6:
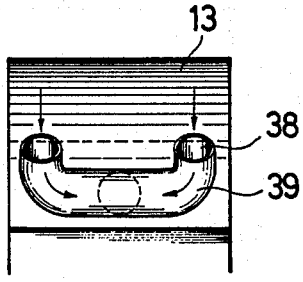
FIG. 6 is a view from the left of the embodiment of FIG. 5.

FIG. 5 shows a modified embodiment, in which use is made of a bent ventilating pipe 37. Ventilating pipe 37 is roughly fork-shaped and contains two inlet ports 38, which are positioned at the ends of fork 39. Centrally fork 39 passes into the lower, linear and horizontal portion 40 of ventilating pipe 37, which with its lower or outlet end 26 also projects somewhat over and beyond the inner wall 20 into the interior of the falling leg 16 of siphon line 13. As in this construction the horizontal portion 40 of ventilating pipe 37 traverses at right angles inner wall 20 and outer wall 19 of siphon line 13, the openings in said walls through which the ventilating pipe is inserted are circular.

Figure 7:
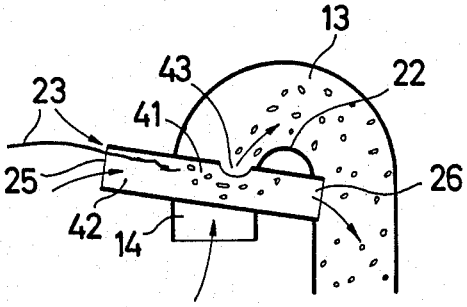
FIG. 7 is an embodiment with a modified ventilating pipe.

In the embodiment according to FIG. 7, the portion 41 of siphon pipe 42 passing through the rising leg 14 of siphon line 13 has a further ventilating opening 43. In the represented position, the air drawn through the upper end 25 of ventilating pipe 42 is sucked both out of the lower ventilating opening 26 arranged on the downstream side of siphon top 22 and from the second ventilating opening 43 arranged at the upstream side of siphon top 22. This leads to a particularly favourable regulating behaviour of the siphon weir proposed by the invention.

In the embodiment according to FIG. 7, the lower edge of the upper end 25 of ventilating pipe 42 and the lower edge of ventilating opening 43 are located below the siphon top 22. Thus, there is a certain water flow through ventilating pipe 42 before water level 23 reaches siphon top 22. In the embodiment according to FIG. 8, this is prevented in that the lower edge 44 of suction opening 45 of ventilating pipe 46 is at the same level as siphon top 22. The second ventilating opening in branch 41 of ventilating pipe 46 is displaced upwards by a short pipe connection 47, so that its edge is at the same level as the siphon top 22. Therefore water can only flow through the siphon weir when the water level has reached the siphon top 22.

Figure 8:
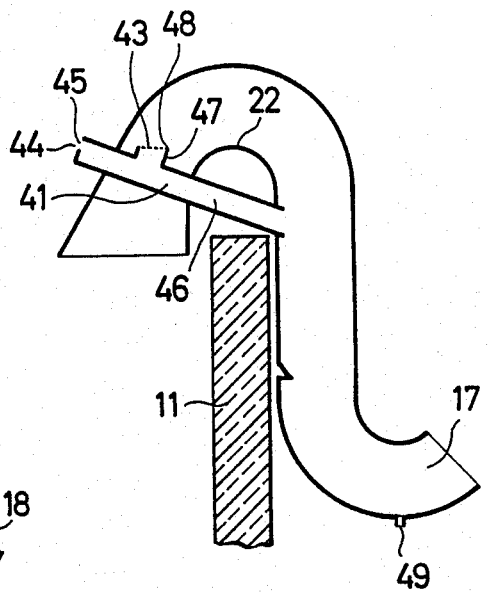
FIG. 8 is a cross-section corresponding to FIG. 1 through a further improved embodiment.

In the embodiment according to FIG. 8, the outflow bend 17 has a small outlet port 49 permitting the outflow of water left standing in bend 17.

Figure 9:
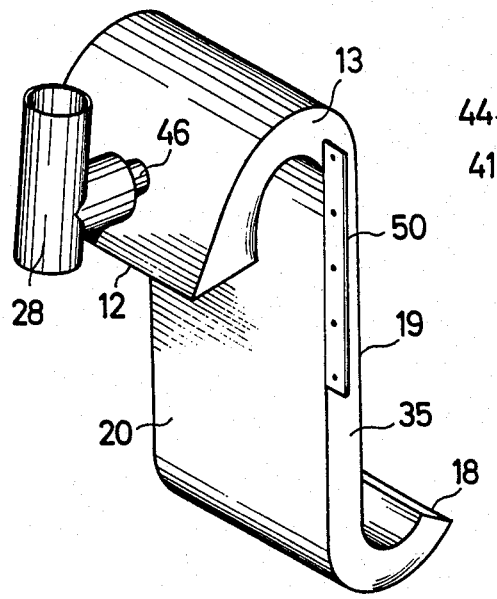
FIG. 9 is a perspective view of an embodiment according to FIG. 8.

FIG. 9 shows in perspective the embodiment according to FIG. 8, in which a diverter 28 for floating material is mounted on the upper end of ventilating pipe 46. The floating material diverter has the same construction and shape as in the embodiment according to FIG. 2. However, it is constructed as a separate component and can be connected to the upper end of ventilating pipe 46. It can in particular be replaced by different types of floating material diverters or simplified suction projections.

The siphon weir according to FIGS. 8 and 9 is constructed as a box-like component, which is formed by outer wall 19, inner wall 20 and two side walls 35 and is in particular made from high-grade steel. In the vicinity of its side walls, it has lateral strips 50 provided with openings, so that it is possible to subsequently fix such a component at a random height of the wall 11 of a container.

We claim:

1. A siphon weir for guiding flow of liquid from an inlet on an upstream side of the siphon weir within a container wall to an outlet on a downstream side of the siphon weir outside the container wall, comprising:

downwardly directed means defining an inlet port to be arranged at the upstream side, the inlet port being connected to a siphon line for the liquid leading along a rising branch from the inlet port, and over a siphon top positioned higher than the inlet port, the siphon line leading further from the siphon top along a falling leg to an outlet port positioned lower than the inlet port, the outlet port to be arranged on the downstream side of the siphon weir; and, a ventilation mechanism for ventilating an interior of the siphon line as a function of a liquid level at the upstream side, the ventilating mechanism having at least one ventilating pipe, with one end issuing into the siphon line downstream of the siphon top, the ventilating pipe having a suction opening at an upper end positioned on the upstream side of the siphon top, roughly level with the siphon top.

2. The siphon weir according to claim 1, wherein the ventilating pipe passes transversely through the rising branch of the siphon line on the upstream side of the siphon weir.

3. The siphon weir according to claim 1, wherein the siphon line at the falling leg on the downstream side is defined by an inner wall and an outer wall, and the ventilating pipe projects beyond the inner wall of the falling leg of the siphon line.

4. The siphon weir according to claim 1, wherein a part of the ventilating pipe is arranged within the rising branch of the siphon line and has a second ventilating opening therein.

5. The siphon weir according to claim 1, wherein a lower edge of the suction opening of the ventilating pipe on the upstream side of the siphon weir is roughly level with the siphon top.

6. The siphon weir according to claim 4, wherein the second ventilating opening (43) has an edge that is level with the siphon top.

7. The siphon weir according to claim 1, further comprising a diverter for floating material at the suction opening of the ventilating pipe.

8. The siphon weir according to claim 1, wherein as viewed in a flow direction from the upstream side to the downstream side, the siphon line has a rectangular cross-section.

9. The siphon weir according to claim 1, further comprising deflectors arranged in the siphon line adjacent an apex of the siphon line on an inside of walls defining the siphon line, the deflectors extending into a vicinity of said one end of the ventilating pipe issuing in the siphon line downstream of the siphon top.

10. The siphon weir according to claim 1, wherein the ventilating pipe is positioned centrally between side walls of the siphon weir defining the siphon line.

11. The siphon weir according to claim 1, wherein the ventilating pipe is linear.

12. The siphon weir according to claim 1, wherein the siphon weir is a box-like component and is separable from the container wall.

13. The siphon weir according to claim 1, wherein the falling leg of the siphon line is constructed as a vertical suction tube with parallel walls.

14. The siphon weir according to claim 1, further comprising means defining an upwardly sloping outlet port at a downstream end of the siphon line.

15. The siphon weir according to claim 1, wherein the siphon weir has a smooth top surface without edges and projections.

16. The siphon weir of claim 7, wherein the diverter for floating material is defined by a tube with openings above and below a surface of liquid in the container, leading to the ventilation pipe.

17. The siphon weir of claim 12, wherein the weir is constructed of steel plates.

* * * * *